United States Patent [19]

Sheth

[11] 4,030,285

[45] June 21, 1977

[54] ELECTRONIC HOUR GLASS CLOCK

[76] Inventor: Harshadrai D. Sheth, 32522 Jaclynn Drive, Union City, Calif. 94587

[22] Filed: Jan. 2, 1976

[21] Appl. No.: 646,150

[52] U.S. Cl. ..... 58/50 R; 58/1 R; 58/23 R; 58/127 R

[51] Int. Cl.[2] ..... G04C 3/00; G04B 19/06

[58] Field of Search ..... 58/1, 23 R, 50 R, 85.5, 58/144

[56] References Cited

UNITED STATES PATENTS

| | | | |
|---|---|---|---|
| 2,745,243 | 5/1956 | Schumacher | 58/50 R |
| 3,744,235 | 7/1973 | Kratomi | 58/50 R |

*Primary Examiner*—E. S. Jackmon
*Attorney, Agent, or Firm*—Brumbaugh, Graves, Donohue & Raymond

[57] ABSTRACT

An electronic clock has a display which simulates the operation of one or more hour glasses. The hour glass display is simulated by the use of visual display elements, such as lights, which are made to appear to pass from the top portion of the hour glass display into the bottom portion of the hour glass display with the passage of time. Means are provided for resetting the hour glass display to put all of the display elements in their original condition and also for cascading multiple hour glass displays to give a visual indication of hours and minutes of time.

22 Claims, 3 Drawing Figures

ELECTRONIC HOUR GLASS CLOCK

BACKGROUND OF THE INVENTION

This invention relates to electronic clocks and in particular to electronic clocks having novel display techniques.

There have been disclosed in the prior art electronic clocks using illuminated displays to indicate the time of day by other than an ordinary clock face. In addition to well-known digital readout clocks which display the time of day in arabic numbers, there have been disclosed clocks which display the time of day in terms of binary numbers using lights, such as described by Cuevas in U.S. Pat. No. 3,841,082 and Miller in U.S. Pat. No. 3,750,384. The displays of Cuevas and Miller both use lights to display the time of day in hours, minutes, and in the case of Miller, seconds, in terms of binary numbers. The displays are characterized in that display elements are illuminated to indicate the presence of a binary digit in a number representing the time of day. In both of these prior art clocks, the number of display elements illuminated at any particular time of day is constantly varying from none, or just a few, to substantially all of the display elements.

Kratomi in U.S. Pat. No. 3,744,235 and Fukumoto in U.S. Pat. No. 3,775,964 disclosed clocks in which the time of day is indicated by a display of illuminated elements representing the number of hours and additional displays of illuminated elements representing fractions of an hour. Kratomi's disclosure makes use of portions of a display to represent the number of hours and the number of selected fractions of an hour. His display is similar to that of Cuevas and Miller in the fact that the number of elements illuminated is representative of the time of day. Fukumoto discloses a switching of the illuminated portion of the display to represent the time of day. Thus, Fukumoto's display either utilizes the number of elements illuminated to indicate the number of the hour, or the illumination of a single element to represent a particular hour of the day. One basic disadvantage with most of the prior art devices is that either during a particular time of day, or during the entire day in a system such as described by Fukumoto, only a few elements of the display are illuminated. Since a digital illuminated clock of this type is most attractive when a large number of elements are illuminated, it is desirable to provide a time display which has at all times a large number of display elements illuminated.

OBJECTS OF THE INVENTION

It is therefore an object of the present invention to provide an electronic clock having a display with a large number of illuminated display elements at all times of day.

It is a further object of the present invention to provide such a clock wherein the representation of the time of day is easily recognized by the observer.

It is a still further object of the present invention to provide such a clock wherein the display simulates the operation of one or more hour glasses.

It is a still further object of this invention to provide a clock where at transition points of time, lights turn on and off in a manner as to create an illusion of motion, to generate an unusual, stimulating and aesthetic display.

In accordance with the present invention there is provided an electronic clock which includes a display with first and second display areas. Each of the display areas has a plurality of display elements which are switchable between first and second display states in response to supplied control signals. Each of the elements in the first display area is associated with a correponding element in the second display area. The clock also includes electronic control means for providing a sequence of the control signals to the display to cause successive ones of the elements in the first display area to be changed from the first to the second display state at selected time intervals and to simultaneously cause the element corresponding thereto in the second display area to be changed from the second to the first display state.

In accordance with a preferred embodiment of the invention there are provided three displays, representative of hours, ten-minute intervals and minutes. The control means includes means for providing a series of pulses at selected time intervals and logic circuits, one for each of the displays, for providing control signals in response to the series of pulses.

For a better understanding of the present invention together with other and further objects thereof, reference is made to the following description, taken in conjunction with the accompanying drawings, and its scope will be pointed out in the appended claims.

DESCRIPTION OF THE PREFERRED EMBODIMENT

Figure 1:
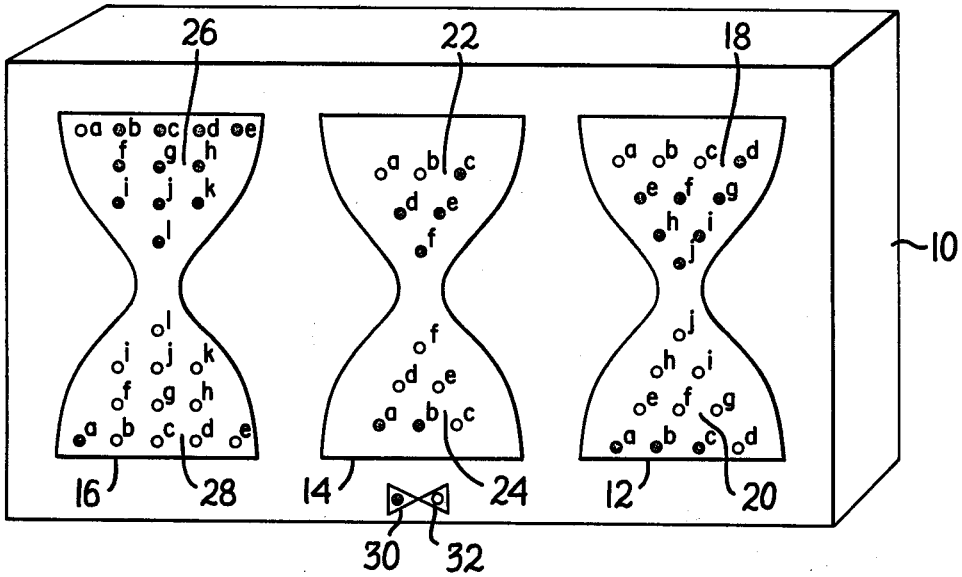
FIG. 1 is a perspective view of a preferred embodiment of the present invention.

Illustrated in FIG. 1 is a perspective view of a preferred embodiment of the invention. The embodiment of FIG. 1 is an electronic clock which includes a housing 10 and first, second and third displays 12, 14 and 16. Each of the displays 12, 14 and 16 is in the overall shape of an hour glass. Display 12 includes the first and second display areas 18 and 20. Each of the display areas 18 and 20 has ten display elements labelled *a* through *j*. Display 14 also has two display areas 22 and 24 with six display elements, *a* through *f*, in each display area. Likewise display 16 has first and second display areas 26 and 28, each having twelve display elements, *a* through *l*.

In the FIG. 1 embodiment the display elements in each display area comprise light bulbs. Each display element has two display states, "off" or "on". Those skilled in the art will recognize that light emitting diodes or liquid crystal display elements may be used in place of light bulbs.

Figure 3:
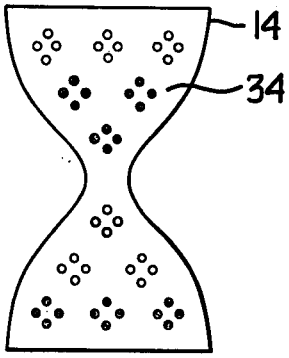
FIG. 3 shows an alternate embodiment of one of the displays illustrated in FIG. 1.

Likewise the display elements for a clock having a large display, may each comprise a group of lights, diodes or similar display devices such as illustrated by groups 34 in FIG. 3.

On the same surface of enclosure 10 as displays 12, 14 and 16 there are included two additional display elements 30 and 32. These display elements are used to simulate the operation of a clock pendulum and to provide assurance to the observer that the electronic portion of the clock is properly functioning.

For purposes of illustration, illuminated display elements in FIG. 1 are shown solid black, while elements which are not illuminated are shown as circles. Time of day is indicated in the FIG. 1 embodiment in accordance with the number of display elements in each of the displays 12, 14 and 16 which are illuminated in the bottom area of each display. For example, display 12 indicates from 1 to 10 minutes. In the illustration three display elements in the bottom area 20 of display 12 are illuminated, and three display elements in the top area 18 of display 12 are not illuminated. This condition indicates three minutes. When another minute passes, element *d* in the top area 18 of display 12 will be extinguished while the corresponding element *d* in the bottom area 20 of display 12 will be illuminated.

Display 14 similarly indicates passage of 10 minute intervals. In the illustration there are two elements, *a* and *b*, in the bottom portion 24 of display 14 which are illuminated. This condition of the display represents two 10-minute time intervals. The number of hours of the day are similarly indicated by the number of elements which are illuminated in the bottom area 28 of display 16. In the condition illustrated by FIG. 1, the time of day represented is 1:23.

It will be evident to those skilled in the art that there may be many variations on the display illustrated in FIG. 1. The hour "twelve" may be represented by none or by twelve lighted elements in the bottom area 28 of display 16. If the hour "twelve" is to be represented by no lights illuminated in display area 28 when the clock reaches 11:59 and advances another minute to 12 o'clock, all 12 display elements in area 28 would be momentarily illuminated and then the display would be reset by reversing the state of all display elements in display 16, that is, extinguishing all elements in area 28 and illuminating all elements in area 26.

An alternate display technique is to have twelve illuminated display elements in area 28 representative of the hour "twelve". In this case one display element *a* in area 28 would be illuminated substantially all the time and one element *a* in area 26 would be extinguished substantially all the time. The remaining display elements of display 16 would be reset when the time reaches 1 o'clock. Thus at 12:59 all display elements in area 28 would be illuminated, and all elements in area 26 would be extinguished. At 1 o'clock elements *b* through l in display area 28 would be extinguished and corresponding elements in area 26 would be illuminated. Consequently since display element *a* in area 28 is always illuminated it need not be provided with time changing control signals but may be directly connected to a source of electrical voltage.

Another variation in display may be realized by recognizing that the six display elements in the bottom portion of display 14, the ten display elements in the bottom portion of display 12 and the twelve elements in the bottom portion of display 16 are not necessarily all illuminated at any time. In the illustrated embodiment after nine minutes have passed all but one of the display elements in area 20 are illuminated and all but one of the elements in area 18 are extinguished. After passage of an additional minute, the last element in area 18 is momentarily extinguished and the last element in area 20 is momentarily illuminated. The display must now be reset by illuminating all of elements in display 18 and extinguishing all the elements in display area 20. Element *j* in display area 20 is therefore illuminated only for a brief interval before display 12 is reset. This interval may be no time at all or may be a time determined in accordance with delay circuitry which will be described hereinafter. Since display element *j* is not used for indication of time over a period it may be eliminated and there may be provided only nine display elements in each of display areas 18 and 20 of display 12. In this case the passage of 10 minutes would be indicated not by the extinguishment and lighting of a single display element *j*, but rather by the undelayed resetting of entire display 12. Simultaneous with the resetting of display 12 one element in area 22 of display 14 is extinguished while a corresponding element in the area 24 is illuminated. Those skilled in the art will recognize that display 14 may have 5 elements in each display area rather than the 6 elements which are illustrated in the diagram. In the event only 5 elements are present the passage of 60 minutes, or six 10-minute intervals, will be represented by the resetting of the elements of display 14. Simultaneous with the resetting of the elements of display 14 an hour-representative element in area 26 of display 16 is extinguished and simultaneously a corresponding element is illuminated in area 28 of display 16.

Similarly display 16 may have 11 elements in each display area. In the event only 11 elements are present, the passage of 12 hours will be represented by resetting of all elements of display 16, simultaneous with the resetting of elements in displays 12 and 14. In this embodiment 12 o'clock would be represented by no illuminated lights in display area 28.

Figure 2:
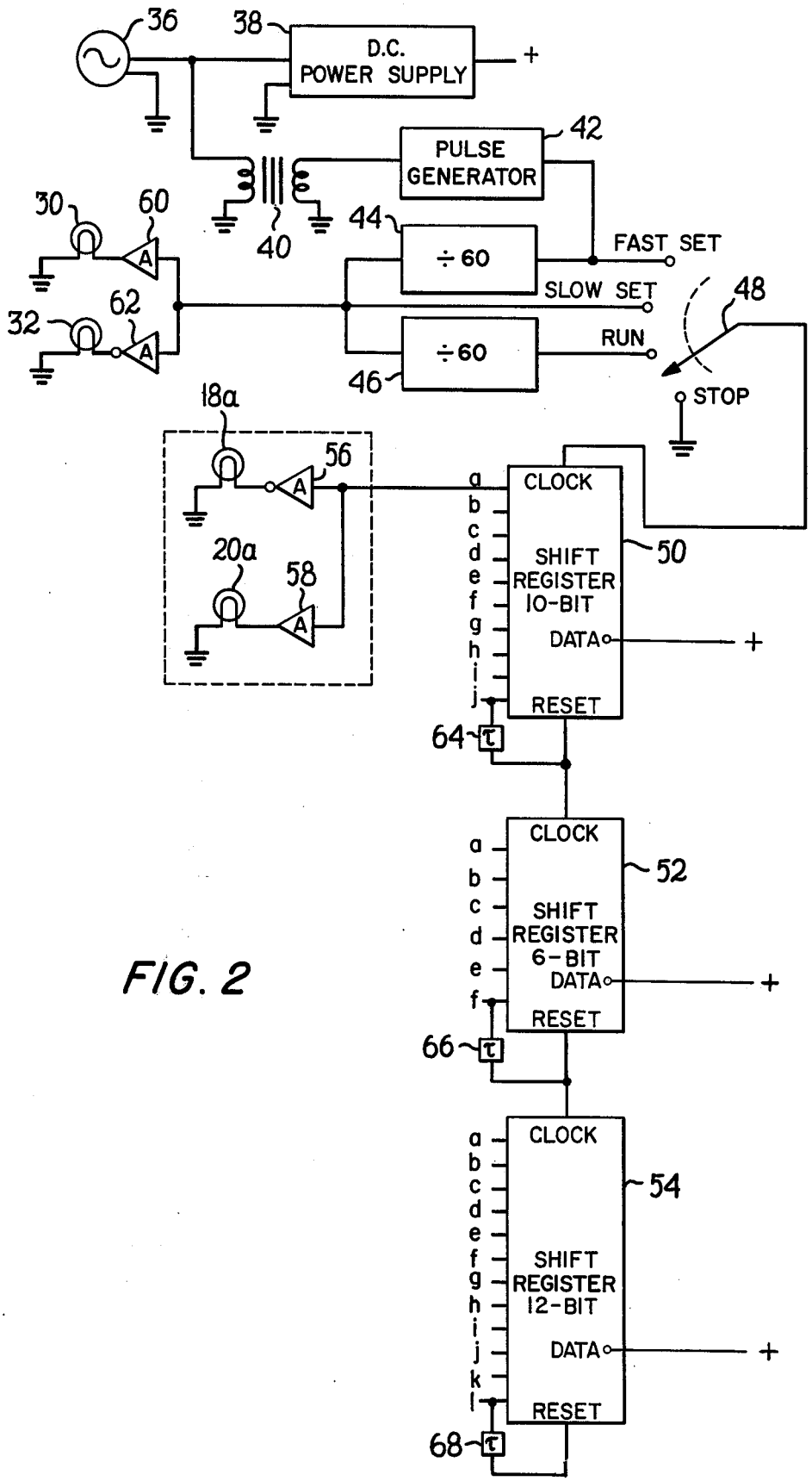
FIG. 2 is a block diagram of the control circuit for the FIG. 1 embodiment.

FIG. 2 is a block diagram of a circuit for supplying control signals to the display elements of the clock illustrated in FIG. 1. The FIG. 2 circuit is most suitable for use where the power supply is an AC electric outlet. Those skilled in the art will recognize that a similar control circuit can be configured using a stable oscillator as a time reference rather than the 60 cycle AC electric current oscillations. Such an arrangement would be suitable where the clock is to be run off batteries or DC current.

As illustrated in FIG. 2, electric current is supplied from 60 Hz current source 36 to transformer 40 and DC power supply 38. DC power supply 38 is designed and selected to supply the DC current requirements of the logic elements and lights used in the clock. Transformer 40 is used to reduce the voltage of the AC current to a voltage compatible with the logic elements used in the circuit. Alternating current from transformer 40 is supplied to pulse generator 42, which reshapes the 60 cycle sinusoidal electric current into square wave pulses. The output of pulse generator 42 is supplied to divider circuit 44 which divides the number of pulses per second by 60 and gives an output of a square wave having one pulse per second. The output of divider 44 is supplied to a second divider 46 which again divides the number of pulses by 60 and results in a square wave output having one pulse per minute. Dividers 44 and 46 are of conventional design and may be fabricated by a combination of digital logic elements, such as binary counters, shift registers, flip-flops, and gates by techniques familiar to those skilled in the art. The outputs of pulse generator 42, divider 44, and divider 46 are all supplied to multiple pole switch 48. In an ordinary "run" setting of switch 48, the output of divider 46 is connected to the clock terminal of serial in-parallel out type shift register 50. The remaining terminals of shift register 50 are configured such that as pulses are supplied to the clock terminal the output terminals *a* through *j* of the shift register change from a "zero" condition to a "one" condition in sequence. Each of the output terminals of shift register 50 are connected to a pair of display elements in display 12. As indicated in the drawing, output terminal *a* of shift register 50 is connected by inverting amplifier 56 and amplifier 58 to display elements 18*a* and 20*a* of display areas 18 and 20 of display 12. Starting from a reset condition and prior to the reception of any pulse into the clock terminal of shift register 50 output *a* is in a "zero" state. Consequently, amplifier 58 supplies no current to display element 20*a* and inverting amplifier 56 supplies current to element 18*a* which is illuminated. When the first clock pulse is received at shift register 50, output *a* changes from a "zero" to a "one" state. Consequently current is supplied by amplifier 58 to display element 20*a* and no current is supplied by inverting amplifier 56 to display element 18*a*. Outputs *b* through *j* of shift register 50 are similarly connected to display elements *b* through *j* within areas 18 and 20 of display 12.

Output *j* of shift register 50 is connected by delay unit 64 to the clock input of serial in-parallel out type shift register 52 and to the reset input of shift register 50. When a 10-minute interval has elapsed and the last of the display elements in display area 18 has been extinguished and correspondingly the last element in display area 20 has been illuminated, following a preset delay of perhaps a few seconds, determined by unit 64, a pulse is supplied to the reset input of shift register 50 which causes all of the outputs *a* through *j* to change from the "one" state to the "zero" state. Shift register 50 will now repeat the process of individually changing the state of the elements in display areas 18 and 20 as additional pulses are supplied to the clock input. The delayed output of terminal *j* of shift register 50 is additionally supplied to the clock input of shift register 52. This delayed pulse supplies a timing pulse to cause one of the elements in display area 22 of display 14 to be extinguished and simultaneously one of the elements of display area 24 to be illuminated. Shift register 52 has six outputs *a* through *f* corresponding to the six display elements in each of the display areas of display 14. Output *f* is connected to the reset terminal of shift register 52 and to shift register 54 by delay device 66 in a manner similar to the connections of terminal *j* of shift register 50.

In accordance with the arrangement illustrated in FIG. 2, shift register 50 is supplied with clock pulses every minute, and supplies shift register 52 with clock pulses at every ten-minute interval. Likewise, shift register 52 supplies pulses to serial in-parallel out type shift register 54 at every one-hour interval. Shift register 50, in combination with amplifiers 56 and 58, supplies control signals to the elements in display 12. Likewise, shift registers 52 and 54, in combination with amplifiers identical to amplifiers 56 and 58, supply control signals to displays 14 and 16, respectively.

It should be noted that the delay units 64, 66 and 68, which delay the resetting of shift registers 50, 52 and 54 following the completion of the cycle of each of those shift registers, are optional and are merely included to add to the esthetic characteristic of the display. If delay units 64, 66 and 68 are not supplied, the resetting of each display 12, 14 and 16 is simultaneous with the changing of the last element in each display.

There is additionally included in the circuit of FIG. 2 amplifier 60 and inverting amplifier 62 which are connected to the output of divider 44. Divider 44 has an output which comprises a square wave having a one second period. Amplifier 60 and inverting amplifier 62 are connected to display elements 30 and 32 which are shown in FIG. 1 on the display face of the clock. By connecting these display elements 30 and 32 by amplifiers 60 and 62 to the output of divider 44, there is provided a flashing of light between elements 30 and 32, each element being illuminated for one-half second. This additional display resembles a pendulum motion and gives the casual observer some assurance that the electronic mechanism of the clock is properly functioning.

In addition to the "run" position of multiple pole switch 48, there is provided in the circuit of FIG. 2 a "slow set" position whereby shift register 50 is connected to the output of divider 44 and a "fast set" position whereby shift register 50 is connected to pulse generator 42. When switch 48 is set to the "slow set" position, pulses are supplied to shift register 50 at one-second intervals, rather than one-minute intervals. The clock is therefore caused to advance at the rate of one minute per second. Likewise, when switch 48 is set to the "fast set" position, pulses from pulse generator 42 are supplied to shift register 50 at the rate of 60 pulses per second. Consequently, the clock would be caused to advance at the rate of 60 minutes, or one hour, per second. Switch 48 can therefore be used for initial setting of the clock, or resetting of the clock when a time change occurs. By turning switch 48 to the "fast set" position, the hour of the day may be easily set since the clock is advanced at the rate of one hour per second. Following setting of the correct hour, switch 48 may be moved to the "slow set" position whereupon the minutes will be advanced at the rate of one minute per second. When the correct time of day is shown on the face of the clock, switch 48 may be moved to the "run" position at which time the clock will operate normally.

While there have been described what are considered to be the preferred embodiments of the invention, those skilled in the art will recognize that other and further modifications may be made thereto, it is therefore intended to include all such variations and modifications as fall within the true spirit and scope of the invention.

I claim:

1. An electronic clock comprising;

a display having first and second display areas, each of said areas having a plurality of display elements, switchable between first and second display states in response to supplied control signals, each of said elements in said first display area being associated with a corresponding element in said second display area; and electronic control means for providing a sequence of said control signals to said display, to cause successive ones of said element in said first display area to be changed from said first to said second display state at selected time intervals, and to simultaneously cause the element corresponding thereto in said second display area to be changed from said second to said first display state and for additionally providing reset signals to cause selected elements in said first area to be in said first display state and selected elements in said second area to be in said second display state after a time period comprising a selected number of said time intervals.

2. A clock as specified in claim 1, wherein said selected number of time intervals is equal to said selected number of display elements in each of said first and second display areas.

3. A clock as specified in claim 1, wherein said display is in the form of an hour glass.

4. A clock as specified in claim 1, wherein there is provided a second display, similar to said first display and having first and second display areas, each of said areas having a plurality of display elements, switchable between first and second display states in response to supplied control signals, each of said elements in said first display area being associated with corresponding elements in said second display area, and wherein said control means provide a second sequence of control signals for changing the states of a plurality of said elements of said second display at second selected time intervals, said second time intervals corresponding to the period at which said reset signals are provided to said first display.

5. A clock as specified in claim 4, wherein said first and second displays are in the form of hour glasses.

6. A clock as specified in claim 1, wherein each of said display elements comprises a light.

7. A clock as specified in claim 1, wherein each of said display elements comprises a plurality of lights.

8. A clock as specified in claim 1, wherein each of said display elements comprises a light emitting diode.

9. A clock as specified in claim 1, wherein each of said display element comprises a liquid crystal display element.

10. An electronic clock comprising:

first, second and third displays, each having first and second display areas, each of said areas having a selected number of display elements, switchable between first and second display states in response to supplied control signals; and electronic control means for providing a sequence of said control signals to said displays, to cause elements in said first display area of each display to be changed from said first to said second display state at selected time intervals for each display, and to cause corresponding elements in said second display area of each display to be simultaneously changed from said second to said first display state, and for providing reset control signals to said displays, to cause selected elements in said first area of each display to be in said first state and selected elements in said second area to be in said second state, after a time period comprising a selected number of said time intervals for each display.

11. A clock as specified in claim 10 wherein said selected time interval for said second display is equal to said reset time period for said first display, and wherein said selected time interval for said third display is equal to said reset time period for said second display.

12. A clock as specified in claim 11 wherein said time interval for said third display is 1 hour.

13. A clock as specified in claim 12 wherein said time interval for said second display is 10 minutes.

14. A clock as specified in claim 13 wherein said time interval for said first display is 1 minute.

15. A clock as specified in claim 14 wherein there are nine display elements in each of said display areas of said first display, wherein there are five display elements in each of said display areas of said second display, and wherein there are eleven display elements in each of said display areas of said third display.

16. A clock as specified in claim 14 wherein there are ten display elements in each of said display areas of said first display, wherein there are six display elements in each of said display areas of said second display, and wherein there are twelve display elements in each of said display areas of said third display.

17. A clock as specified in claim 10 wherein each of said displays is in the form of an hour glass, and wherein said first and second display areas comprise the upper and lower portions of said hour glass.

18. A clock as specified in claim 10 wherein said control means comprises:

means for supplying a series of pulses having a time interval between pulses; and first, second and third logic circuits, responsive to said series of pulses for supplying control signals to the display elements of said first, second and third displays, respectively.

19. A clock as specified in claim 18 wherein:

said first logic circuit comprises a shift register, responsive to said series of pulses, and including means for providing a first reset signal after a selected number of supplied pulses;

said second logic circuit comprises a shift register, responsive to said first reset signal, and including means for providing a second reset signal after a selected number of said first reset signals; and said third logic circuit comprises a shift register, responsive to said second reset signal and including means for providing a third reset signal after a selected number of said second reset signals.

20. A clock as specified in claim 18 wherein said means for supplying pulses additionally includes means for varying said time interval between pulses.

21. A clock as specified in claim 18, wherein said first, second, and third logic circuits each include a plurality of driver circuits comprising an inverting amplifier and a noninverting amplifier, said amplifiers having outputs connected to corresponding display elements in corresponding first and second display areas.

22. A clock as specified in claim 10 wherein there is provided a display element in addition to the display elements in said first, second, and third displays and means for causing said additional display element to flash alternately between first and second display states.

* * * * *